US009594335B2

(12) United States Patent
Saiki

(10) Patent No.: US 9,594,335 B2
(45) Date of Patent: Mar. 14, 2017

(54) HEAT SENSING DEVICE, FIXING DEVICE, AND IMAGE FORMING APPARATUS

(71) Applicant: FUJI XEROX CO., LTD., Tokyo (JP)

(72) Inventor: Mikio Saiki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/050,806

(22) Filed: Feb. 23, 2016

(65) Prior Publication Data

US 2017/0045849 A1 Feb. 16, 2017

(30) Foreign Application Priority Data

Aug. 13, 2015 (JP) ..... 2015-159826

(51) Int. Cl.
*G03G 15/00* (2006.01)
*G03G 15/20* (2006.01)

(52) U.S. Cl.
CPC ..... *G03G 15/2053* (2013.01)

(58) Field of Classification Search
CPC ..... G03G 15/2039; G03G 15/2053; G03G 2215/2025
USPC ..... 399/33, 67, 69, 328, 329
See application file for complete search history.

(56) References Cited

U.S. PATENT DOCUMENTS

2014/0093290 A1* 4/2014 Soeda ..... G03G 15/2039 399/329
2014/0294467 A1* 10/2014 Ishida ..... G03G 15/2039 399/329

FOREIGN PATENT DOCUMENTS

JP 2006-163297 A 6/2006
JP 2009-163039 A 7/2009

* cited by examiner

*Primary Examiner* — Walter L Lindsay, Jr.
*Assistant Examiner* — Jessica L Eley
(74) *Attorney, Agent, or Firm* — Oliff PLC

(57) ABSTRACT

A heat sensing device includes a heat sensing element that contacts an inner surface of a surface heater extending in an arc shape, the inner surface having the arc shape, and that senses that a temperature of the surface heater exceeds a predetermined temperature; a spring member one end of which is fixed to the heat sensing element and that presses the heat sensing element against the inner surface of the surface heater; and a supporting body that supports the other end of the spring member, the other end being away from the heat sensing element, in such a way that the other end is movable in a direction in which the surface heater extends in the arc shape.

10 Claims, 5 Drawing Sheets

HEAT SENSING DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2015-159826 filed Aug. 13, 2015.

BACKGROUND (i) Technical Field

The present invention relates to a heat sensing device, a fixing device, and an image forming apparatus.

(ii) Related Art

To sense the temperature of a surface heater extending in an arc shape, such as an endless belt, by using a heat sensing element that contacts an inner surface having the arc shape, it is necessary to make the heat sensing element uniformly contact the inner surface.

SUMMARY

According to an aspect of the invention, a heat sensing device includes a heat sensing element that contacts an inner surface of a surface heater extending in an arc shape, the inner surface having the arc shape, and that senses that a temperature of the surface heater exceeds a predetermined temperature; a spring member one end of which is fixed to the heat sensing element and that presses the heat sensing element against the inner surface of the surface heater; and a supporting body that supports the other end of the spring member, the other end being away from the heat sensing element, in such a way that the other end is movable in a direction in which the surface heater extends in the arc shape.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described with reference to the drawings.

Figure 1:
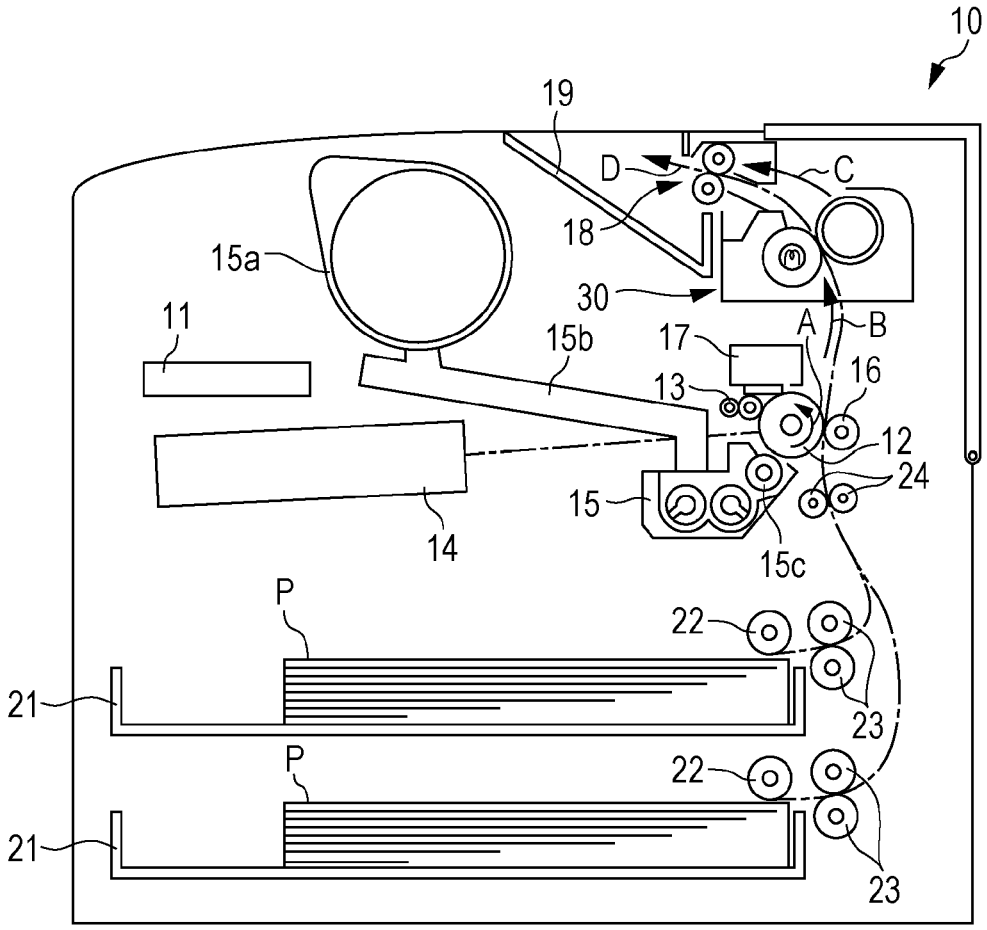
FIG. 1 is a schematic view of a printer, which is an image forming apparatus according to an exemplary embodiment of the present invention.

FIG. 1 is a schematic view of a printer 10, which is an example of an image forming apparatus according an exemplary embodiment the present invention.

The printer 10 illustrated in FIG. 1 is a monochrome printer. The printer 10 includes a fixing device according to an exemplary embodiment of the present invention and a heat sensing device according to an exemplary embodiment of the present invention.

An image signal, which has been generated by an external apparatus, is input to the printer 10 through a signal cable or the like (not shown). The printer 10 includes a controller 11 that controls various components of the printer 10. The image signal is input to the controller 11. Under the control by the controller 11, the printer 10 forms an image based on the image signal.

Two sheet trays 21, in each of which a stack of sheets P are loaded, are disposed in a lower part of the printer 10. The size of sheets P loaded in one of the sheet trays 21 differ from that of sheets P loaded in the other sheet tray 21. It is possible to pull out the sheet trays 21 when loading the sheets P into the sheet trays 21.

A pick-up roller 22 feeds some of the sheets P from one of the sheet trays 21 that holds the sheets P having a size that is appropriate for printing an image represented by an image signal input to the controller 11. Separation rollers 23 separate the sheets P, fed by the pick-up roller 22, into individual sheets. One of the separated sheets P is transported upward, and the leading end of the sheet P reaches registration rollers 24, which have a function of feeding the sheet P after adjusting the timing with which the sheet P is to be transported. The sheet P, which has reached the registration rollers 24, is transported further at a timing adjusted by the registration rollers 24.

The printer 10 includes a photoconductor 12, which rotates in the direction indicated by an arrow A, above the registration rollers 24. A charging unit 13, an exposure unit 14, a developing unit 15, a transfer unit 16, and a photoconductor cleaner 17 are disposed around the photoconductor 12.

The photoconductor 12 has a cylindrical shape extending in the direction perpendicular the plane of FIG. 1. The photoconductor 12 holds charges when it is charged and releases some of the charges when it is exposed to light, and thereby an electrostatic latent image is formed on the surface of the photoconductor 12.

The charging unit 13 includes a charging roller that rotates while contacting the photoconductor 12. The charging roller charges the surface of the photoconductor 12 by applying charges to the photoconductor 12. Instead of being a charging unit having a charging roller, the charging unit 13 may be a corona-charging unit that charges the photoconductor 12 without contacting the photoconductor 12.

The exposure unit 14 includes a light emitter and a rotary polygon mirror. The light emitter emits a laser beam (exposure light) that is modulated in accordance with an image signal supplied from the controller 11. The rotary polygon mirror scans the photoconductor 12 with the laser beam. When the photoconductor 12 is exposed to the exposure light emitted from the exposure unit 14, an electrostatic latent image is formed on the surface of the photoconductor 12. Instead of being an exposure unit that uses a laser beam, the exposure unit 14 may be an LED array in which multiple LEDs are arranged in the scanning direction. A latent image may be formed by using a method other than the exposure method, such as a method of directly forming a latent image by using multiple electrodes that are arranged in the scanning direction.

The developing unit 15 develops the electrostatic latent image, which is formed on the surface of the photoconductor 12 exposed to light. A toner container 15*a* is connected to the developing unit 15 through a toner supply path 15*b*. A developer, which is composed of a toner and a magnetic carrier, is contained in the developing unit 15. The toner in the toner container 15*a* is supplied to the developing unit 15 through the toner supply path 15*b* as necessary. The magnetic carrier is, for example, iron powder that is composed of particles whose surfaces are coated with a resin. The toner is composed of particles that are made of, for example, a binder resin, a colorant, and a release agent. The developing unit 15 charges the toner and the magnetic carrier by agitating the developer, which is a mixture of toner particles and magnetic carrier particles. The developing unit 15 includes a developing roller 15*c* that supplies the developer in the developing unit 15 to the photoconductor 12. The developing unit 15 forms a toner image by developing the latent image on the surface of the photoconductor 12 by using charged toner in the developer.

The registration rollers 24 feed the sheet P so that the sheet P reaches a position facing the transfer unit 16 at the same time as the toner image on the photoconductor 12 reaches the position. The transfer unit 16 transfers the toner image on the photoconductor 12 to the sheet P, which has been fed to the position. The transfer unit 16 may be a device including an intermediate transfer member. In this case, a toner image on the photoconductor 12 is temporarily transferred the intermediate transfer member, and the toner image on the intermediate transfer member is transferred to the sheet P.

The photoconductor cleaner 17 removes, from the photoconductor 12, toner that remains on the photoconductor 12 after the toner image has been transferred to the sheet P.

The photoconductor 12, the charging unit 13, the exposure unit 14, the developing unit 15, and the transfer unit 16 correspond to an example of an image forming device in the present invention.

The sheet P, to which the toner image has been transferred, is transported further in the direction indicated by an arrow B. A fixing unit 30 heats and presses the sheet P to fix the toner image onto the sheet P. As a result, an image, which is a fixed toner image, is formed on the sheet P. The fixing unit 30 corresponds to a fixing device according to an exemplary embodiment of the present invention. As described below, the fixing unit 30 includes a heat sensing device according to an exemplary embodiment of the present invention.

After passing through the fixing unit 30, the sheet P is transported in the direction indicated by an arrow C toward an output unit 18. The output unit 18 transports the sheet P in the direction indicated by an arrow D and outputs the sheet P onto an output tray 19.

The mechanism of the printer 10 that feeds the sheet P from the sheet tray 21, transports the sheet P through a space between the photoconductor 12 and the transfer unit 16 and through the fixing unit 30, and outputs the sheet P onto the output tray 19 corresponds to an example of a transport device in the present invention.

Figure 2:
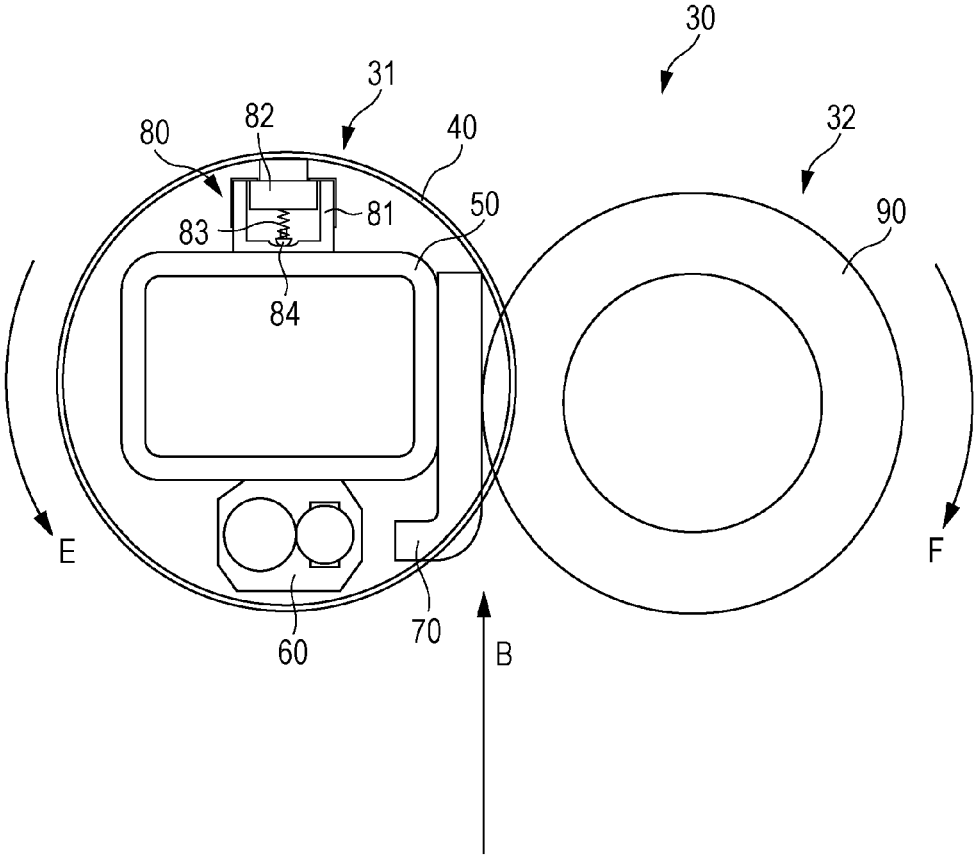
FIG. 2 is a cross-sectional view of a fixing unit.

FIG. 2 is a cross-sectional view of the fixing unit 30.

The fixing unit 30 includes a heating unit 31 and a pressing unit 32. The heating unit 31 corresponds to an example of a heating device in the present invention. The pressing unit 32 corresponds to an example of a pressing device in the present invention.

The heating unit 31 includes an endless heating belt 40. The heating unit 31 includes a supporting member 50, a heating lamp 60, a nip member 70, and a heat sensing unit 80, which are disposed inside the heating belt 40. The heating belt 40 corresponds to an example of a surface heater in the present invention. The heat sensing unit 80 corresponds to an example of a heat sensing device in the present invention.

The supporting member 50 extends in the direction perpendicular to the plane of FIG. 2. Both end portions of the supporting member 50, which protrude from both edges of the heating belt 40, are supported by a housing of the printer 10 (FIG. 1). The supporting member 50 serves as a supporting base for supporting other members disposed inside the heating belt 40.

The heating lamp 60, which is supported by the supporting member 50, has a function of heating the heating belt 40.

The nip member 70 has a function of receiving a pressing force from a pressing roller 90 when the heating belt 40 is pressed by the pressing roller 90 (described below).

In FIG. 2, a part of the nip member 70 extends beyond the outline of the heating belt 40, because FIG. 2 illustrates the heating belt 40 in its original shape when there is no interference between the heating belt 40 and the nip member 70 and the like. In reality, the nip member 70 is disposed inside the heating belt 40, and the heating belt 40 is pressed by the pressing roller 90 (described below) and deformed so as to have a shape corresponding to the shape of the nip member 70.

The heat sensing unit 80 is also fixed to the supporting member 50. The heat sensing unit 80 includes a holder 81, a thermostat 82, a coil spring 83, and a spherical member 84. The holder 81 corresponds to an example of a supporting body in the present invention, and the thermostat 82 corresponds to an example of a heat sensing element in the present invention. The coil spring 83 corresponds to an example of a spring member in the present invention, and the spherical member 84 corresponds to an example of a spherical member in the present invention. The detailed structure of the heat sensing unit 80 will be described below.

The pressing unit 32 of the fixing unit 30 includes the pressing roller 90. As described above, the pressing roller 90 presses the heating belt 40 against the nip member 70. The pressing roller 90 has a surface layer made of a rubber. A part of the pressing roller 90 that presses the heating belt 40 against the nip member 70 is deformed so as to have a shape corresponding to the shape of a surface of the nip member 70 with the heating belt 40 therebetween. Accordingly, a region of the heating belt 40 nipped between the nip member 70 and the pressing roller 90 is deformed so as to have a shape corresponding to the shape of the surface of the nip member 70.

The pressing roller 90 rotates in the direction indicated by an arrow F while pressing the heating belt 40 against the nip member 70. As the pressing roller 90 rotates, the heating belt 40 is rotated in the direction indicated by an arrow E.

After the transfer unit 16 illustrated in FIG. 1 has transferred the toner image to the sheet P, the sheet P is transported in the direction of the arrow B shown in FIGS. 1 and 2 to the fixing unit 30. The sheet P is heated and pressed between the heating belt 40 and the pressing roller 90, and thereby the toner image is fixed onto the sheet P. After the toner image has been fixed onto the sheet P, the sheet P is transported in the direction of the arrow C shown in FIG. 1 and is output by the output unit 18 in the direction of arrow D onto the output tray 19.

Next, the structure of the heat sensing unit 80 will be described.

Figure 3:
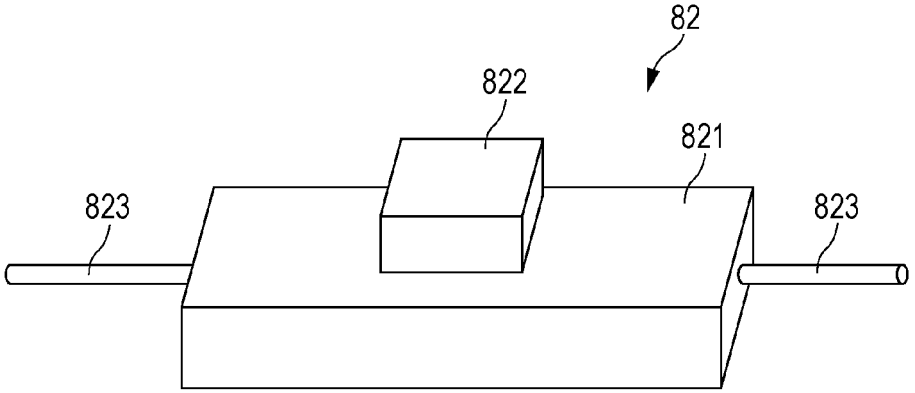
FIG. 3 is a schematic perspective view of a thermostat of a heat sensing unit.

FIG. 3 is a schematic perspective view of the thermostat 82 of the heat sensing unit 80.

As illustrated in FIG. 3, the thermostat 82 includes a base 821, which has a horizontal rectangular-parallelepiped shape, and a heat sensing unit 822, which protrudes upward from the base 821. Wires 823 extend from the base 821. The heat sensing unit 822 of the thermostat 82 illustrated in FIG. 3 has a substantially rectangular shape in plan view. However, there are other types of thermostats including a heat sensing unit having a substantially circular shape in plan view.

The heat sensing unit 822 of the thermostat 82 is pressed against an inner surface of the heating belt 40 (see FIG. 2). When the heat sensing unit 822 senses that the temperature of the heating belt 40 exceeds a predetermined temperature, the thermostat 82 electrically disconnects the wires 823 from each other.

When the thermostat 82 senses that the temperature of the heating belt 40 exceeds a predetermined temperature, the fixing unit 30 performs operations for preventing further increase of the temperature, such as an operation of switching off an electric current to the heating lamp 60 and an operation of stopping the rotation of the pressing roller 90.

The thermostat 82 is urged by the coil spring 83, and therefore the heat sensing unit 822 of the thermostat 82 is pressed against an inner surface of the heating belt 40. Depending on the direction in which the heat sensing unit 822 is pressed against the inner surface, a phenomenon in which the heat sensing unit 822 comes into "one-side contact" with the heating belt 40 might occur.

Figure 4:
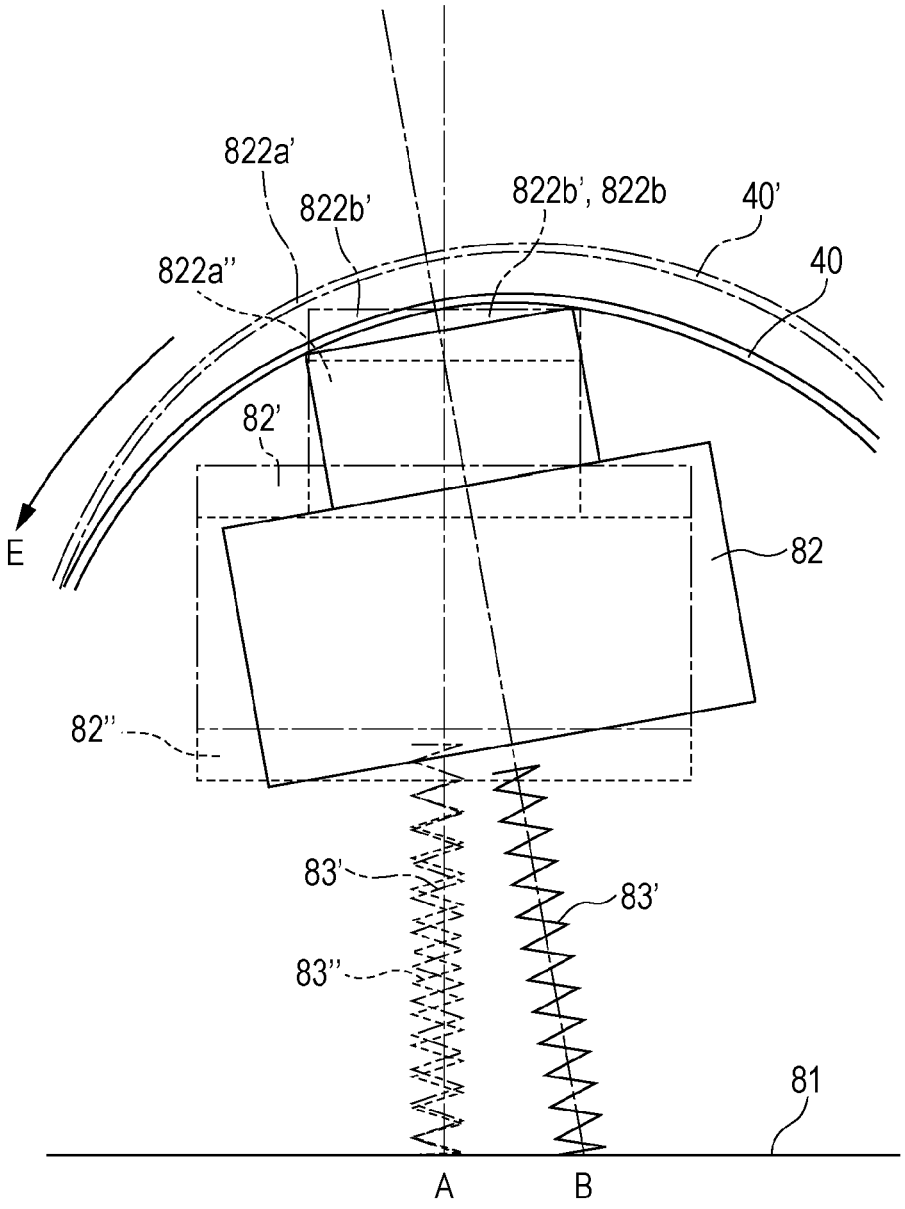
FIG. 4 illustrates a one-side contact phenomenon.

FIG. 4 illustrates the one-side contact phenomenon.

FIG. 4 illustrates the thermostat 82 in a state in which the heat sensing unit 822 is pressed against the inner surface of the heating belt 40.

In FIG. 4, the thermostat 82 is represented by a solid line, a thermostat 82' is represented by a chain line, and a thermostat 82" is represented by a broken line.

The thermostats 82, 82', and 82" illustrated in FIG. 4, which are respectively represented by a solid line, a chain line, and a broken line, are physically the same thermostat that is illustrated to be in different positions and orientations, overlapping each other, in accordance with the situations.

The thermostat 82', which is represented by a chain line in FIG. 4, is in a state in which a heat sensing unit 822' thereof is in "one-side contact" with a heating belt 40', which is also represented by a chain line. That is, the thermostat 82' is in the following state in which: a downstream edge 822*a'* of the heat sensing unit 822', which is downstream in the rotation direction (indicated by an arrow E) of the heating belt 40', is in contact with the inner surface of the heating belt 40'; and an upstream edge 822*b'*, which is located upstream in the rotation direction, is separated from the inner surface of the heating belt 40'. Conversely, "one-side contact" might also occur in such a way that only the upstream edge 822*b'* is in contact with the heating belt 40' and the downstream edge 822*a'* is separated from the heating belt 40'. If such one-side contact occurs, the thermostat 82 might sense heat with an error in temperature or with a delay in response.

The thermostat 82, which is represented by a solid line, is inclined as compared with the thermostat 82', which is represented by a chain line. Both of a downstream edge 822*a* and an upstream edge 822*b* of the heat sensing unit 822 of the thermostat 82 are in contact with the inner surface of the heating belt 40. That is, with the thermostat 82 represented by a solid line, "one-side contact" of the heat sensing unit 822 has been resolved.

Here, it is assumed that, due to tolerance for assembly and displacement of the heating belt 40' in operation, one-side contact as represented by a chain line in FIG. 4 has occurred.

At this time, the downstream edge 822*a'* of the heat sensing unit 822' receives a force from the heating belt 40', and a rotational moment toward a position represented by a solid line is generated. However, if a coil spring 83' were fixed at a point A of the holder 81, one-side contact of the heat sensing element 822' of the thermostat 82' would not be resolved. Thus, even if the heating belt 40' represented by a chain line became displaced to the position of the heating belt 40 represented by a solid line, the thermostat 82' represented by a chain line might be continued to be pressed by the heating belt 40' and moved to the position of the thermostat 82" represented by a broken line. To prevent this, the present exemplary embodiment has such a structure that, when the one-side contact occurs, an end of the coil spring 83' adjacent to the holder 81 moves from the point A to the point B. Due to this movement, one-side contact is resolved.

Figure 5:
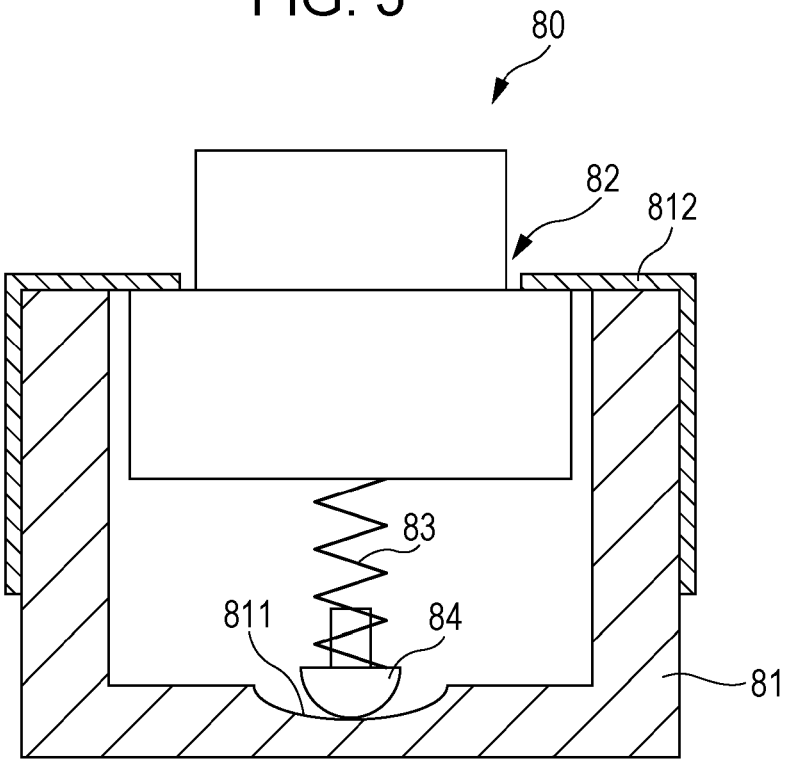
FIG. 5 is an enlarged cross-sectional view of the heat sensing unit.

FIG. 5 is an enlarged cross-sectional view of the heat sensing unit.

The spherical member 84 is attached to the end of the coil spring 83 adjacent to the holder 81. The spherical member 84 has a spherical surface that contacts the holder 81.

The holder 81 has a recessed portion 811, which is recessed in an arc shape or a spherical shape, in a part thereof that the spherical member 84 contacts. The spherical member 84 slidably contacts the recessed portion 811.

The thermostat 82 is pressed upward by the coil spring 83 against a stopper 812 of the holder 81.

Figure 6:
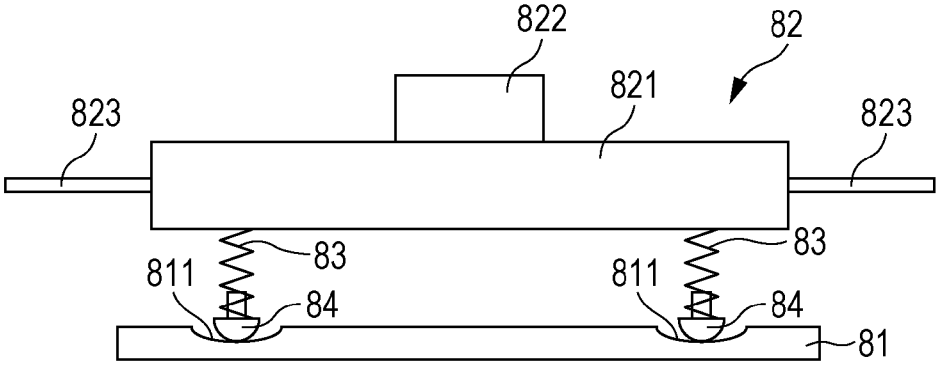
FIG. 6 is a front view of the thermostat as seen in the longitudinal direction of the thermostat.

FIG. 6 is a front view of the thermostat as seen in the longitudinal direction thereof.

As illustrated in FIG. 6, the thermostat 82 is supported by two coil springs 83 at both end portions thereof in the longitudinal direction.

In the present exemplary embodiment, the thermostat 82 is disposed in such a way that the longitudinal direction thereof coincides with the axial direction of the heating belt 40. Accordingly, as illustrated in FIG. 5, only one of the coil springs 83 is disposed in a direction in which the heating belt 40 extends in an arc shape, that is, in the rotation direction (indicated by an arrow E) of the heating belt 40. Because only one coil spring 83 is disposed in this direction, reduction in the size of the heat sensing unit 80 is realized, and one-side contact is prevented because the spherical member 84 slides in the recessed portion 811.

Figure 7A:
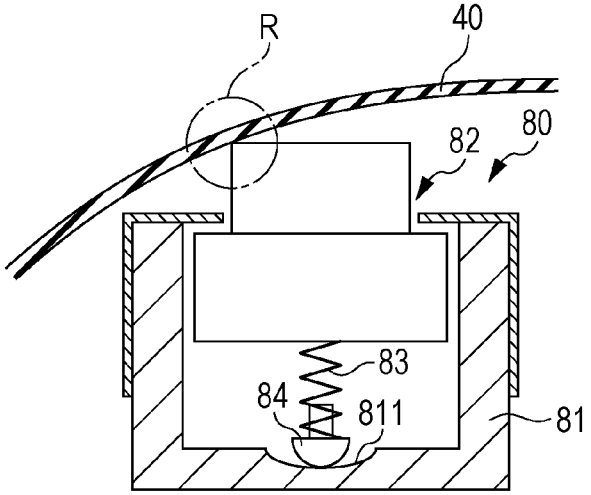
FIGS. 7A to 7C are schematic views illustrating movement of the thermostat when one-side contact occurs.
Figure 7B:
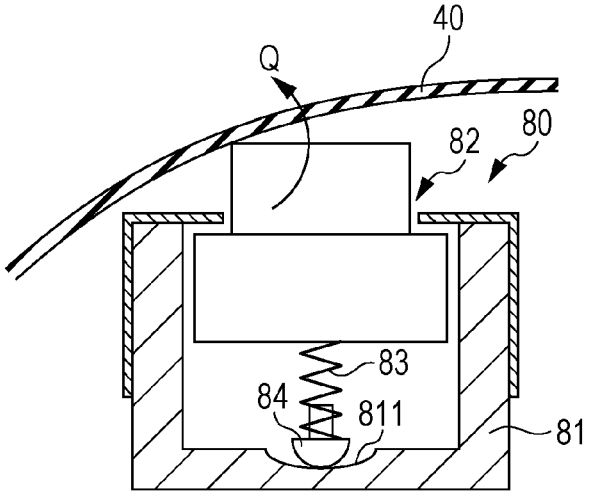
Figure 7C:
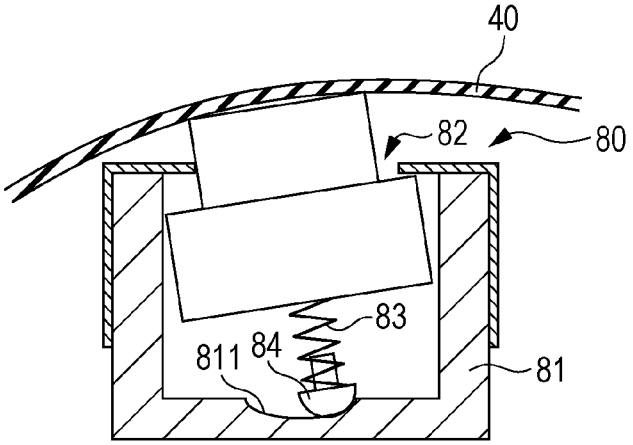

FIGS. 7A to 7C are schematic views illustrating movement of the thermostat when one-side contact occurs.

FIG. 7A illustrates a state immediately after one-side contact has occurred.

In FIG. 7A, one-side contact is occurring in a circle R. When the one-side contact occurs, a rotation moment in the direction indicated by an arrow Q in FIG. 7B is generated. Accordingly, the spherical member 84 slides in the recessed portion 811 of the holder 81 as illustrated in FIG. 7C, and the coil spring 83 presses the thermostat 82, which is in an inclined state, against the inner surface of the heating belt 40 so that the one-side contact is resolved.

With the present exemplary embodiment, by avoiding one-side contact of the heat sensing unit 822 in this way, it is possible to stably sense the heat of the heating belt 40 constantly.

In the exemplary embodiment described above, the heat sensing unit 80 is used to sense the heat of the heating belt 40 of the fixing unit 30 of the printer 10 illustrated in FIG. 1. However, a heat sensing device according to the present invention in not used only to sense the heat of the heating belt 40. It is possible to apply the present invention to a device that contacts an inner surface of a surface heater extending in an arc shape, the inner surface having the arc shape, and that senses that the temperature of the surface heater exceeds a predetermined temperature. It is possible to use a heat sensing device according to the present invention not only in the fixing unit 30 having the structure illustrated in FIG. 3 and the printer 10 having the structure illustrated in FIG. 1, but also in any devices that include an arc shaped surface heater whose heat needs to be sensed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heat sensing device comprising:

a heat sensing element that contacts an inner surface of a surface heater extending in an arc shape, the inner surface having the arc shape, and that senses that a temperature of the surface heater exceeds a predetermined temperature;

a spring member one end of which is fixed to the heat sensing element and that presses the heat sensing element against the inner surface of the surface heater; and a supporting body that supports the other end of the spring member, the other end being away from the heat sensing element, in such a way that the other end is movable in a direction in which the surface heater extends in the arc shape.

2. The heat sensing device according to claim 1, wherein the supporting body moves the other end of the spring member, the other end being adjacent to the supporting body, so that the spring member presses both edges of the heat sensing element, which are separated from each other in the direction in which the surface heater extends in the arc shape, against the inner surface of the surface heater.

3. The heat sensing device according to claim 2, further comprising:

a spherical member that is supported by the other end the spring member, which is adjacent to the supporting body, and that has a spherical surface that contacts the supporting body, wherein the supporting body includes a recessed portion that the spherical member slidably contacts.

4. The heat sensing device according to claim 3, wherein the spring member includes a plurality of coil springs and only one of the coil springs is disposed in the direction in which the surface heater extends in the arc shape.

5. The heat sensing device according to claim 2, wherein the spring member includes a plurality of coil springs and only one of the coil springs is disposed in the direction in which the surface heater extends in the arc shape.

6. The heat sensing device according to claim 1, further comprising:

a spherical member that is supported by the other end the spring member, which is adjacent to the supporting body, and that has a spherical surface that contacts the supporting body, wherein the supporting body includes a recessed portion that the spherical member slidably contacts.

7. The heat sensing device according to claim 6, wherein the spring member includes a plurality of coil springs and only one of the coil springs is disposed in the direction in which the surface heater extends in the arc shape.

8. The heat sensing device according to claim 1, wherein the spring member includes a plurality of coil springs and only one of the coil springs is disposed in the direction in which the surface heater extends in the arc shape.

9. A fixing device comprising:

a heating device including an endless heating belt that rotates, and the heat sensing device according to claim 1 for which the surface heater is the endless heating belt; and a pressing device that nips a sheet, which has a powder image thereon and which has been transported to the pressing device, between the pressing device and the heating belt and that presses the sheet against the heating belt.

10. An image forming apparatus comprising:

an image forming device that forms a powder image on a sheet transported thereto;

the fixing device according to claim 9; and a transport device that transports the sheet along a transport path passing through the image forming device and the fixing unit.

* * * * *